US008296953B2

(12) United States Patent
Bühler et al.

(10) Patent No.: US 8,296,953 B2
(45) Date of Patent: Oct. 30, 2012

(54) METHOD OF MANUFACTURING A ONE-PIECE HAIRSPRING

(75) Inventors: Pierre-André Bühler, Orvin (CH); Marco Verardo, Les Bois (CH); Thierry Conus, Lengnau (CH); Jean-Philippe Thiebaud, Cudrefin (CH); Jean-Bernard Peters, La Chaux-de-Fonds (CH); Pierre Cusin, Villars-Burquin (CH)

(73) Assignee: Montres Breguet S.A., L'Abbaye (CH)

( * ) Notice: Subject to any disclaimer, the term of this patent is extended or adjusted under 35 U.S.C. 154(b) by 693 days.

(21) Appl. No.: 12/414,309

(22) Filed: Mar. 30, 2009

(65) Prior Publication Data

US 2009/0245030 A1 Oct. 1, 2009

(30) Foreign Application Priority Data

Mar. 28, 2008 (EP) ..... 08153598

(51) Int. Cl.
*G04D 3/00* (2006.01)
*G04B 17/06* (2006.01)

(52) U.S. Cl. ..... 29/896.31; 29/896.3; 29/896.8; 29/896.9; 368/175

(58) Field of Classification Search ..... 29/896.8, 29/896.9, 896.3, 896.31; 368/175; 267/151, 267/272

See application file for complete search history.

(56) References Cited

U.S. PATENT DOCUMENTS

| | | | | |
|---|---|---|---|---|
| 3,553,956 | A | 1/1971 | Schwartz et al. | |
| 4,571,661 | A * | 2/1986 | Hoshino | 361/283.1 |
| 5,576,250 | A * | 11/1996 | Diem et al. | 438/50 |
| 7,018,092 | B2 * | 3/2006 | Muller | 368/140 |
| 7,077,562 | B2 | 7/2006 | Bourgeois et al. | |
| 7,148,603 | B1 * | 12/2006 | Garcia et al. | 310/309 |
| 7,213,966 | B2 | 5/2007 | Lambert et al. | |
| 7,229,208 | B2 | 6/2007 | Verardo et al. | |
| 2005/0219957 | A1 | 10/2005 | Lambert et al. | |
| 2005/0281137 | A1 | 12/2005 | Bourgeois et al. | |
| 2006/0002241 | A1 | 1/2006 | Verardo et al. | |
| 2006/0055097 | A1 * | 3/2006 | Conus et al. | 267/273 |
| 2008/0037376 | A1 * | 2/2008 | Lippuner et al. | 368/139 |

FOREIGN PATENT DOCUMENTS

| | | | |
|---|---|---|---|
| CH | 695 395 | A5 | 4/2006 |
| DE | 10127733 | A1 * | 2/2003 |
| EP | 0 732 635 | A1 | 9/1996 |
| EP | 1 422 436 | | 5/2004 |

(Continued)

OTHER PUBLICATIONS

European Search Report issued in corresponding application No. EP 08 15 3598, completed Nov. 13, 2008.

*Primary Examiner* — Sarang Afzali
(74) *Attorney, Agent, or Firm* — Griffin & Szipl, P.C.

(57) ABSTRACT

The invention relates to a one-piece hairspring (21, 21') including, a balance spring (25, 25') coaxially mounted on a collet (27, 27'), made in the same layer of silicon-based material. According to the invention, the hairspring includes an elevation device (2, 2') for the outer coil of the balance spring above the layer of silicon-based material so as to improve the concentric development of the hairspring. The invention also relates to a timepiece including a hairspring of this type and the method of manufacturing the same. The invention concerns the field of timepiece movements.

10 Claims, 5 Drawing Sheets

FOREIGN PATENT DOCUMENTS

| | | | |
|---|---|---|---|
| EP | 1 584 994 | A1 | 10/2005 |
| EP | 1 605 323 | A2 | 12/2005 |
| EP | 1 612 627 | | 1/2006 |
| EP | 1 655 642 | A2 | 5/2006 |
| EP | 1 837 722 | A2 | 9/2007 |
| FR | 2 063 156 | | 7/1971 |
| FR | 2 315 714 | | 1/1977 |
| JP | 2005106819 | A * | 4/2005 |

* cited by examiner

METHOD OF MANUFACTURING A ONE-PIECE HAIRSPRING

This application claims priority from European Patent Application No. 08153598.1, filed Mar. 28, 2008, the entire disclosure of which is incorporated herein by reference.

FIELD OF THE INVENTION

The invention concerns a hairspring and the method of manufacturing the same and, more specifically, a hairspring with a raised terminal curve formed in a single piece.

BACKGROUND OF THE INVENTION

The regulating member of a timepiece generally includes an inertia wheel, called a balance, and a resonator called a hairspring. These parts have a determining role as regards the working quality of the timepiece. Indeed, they regulate the movement, i.e. they control the frequency of the movement.

In the case of a hairspring with a raised terminal curve, many materials and methods have been tested, but without resolving difficulties as regards resonant assembly

SUMMARY OF THE INVENTION

It is an object of the present invention to overcome all or part of the aforecited drawbacks, by providing a one-piece hairspring with a raised terminal curve, whose thermo-elastic coefficient can be adjusted and which is obtained using a manufacturing method that minimises assembly difficulties.

The invention therefore concerns a one-piece hairspring that includes a balance spring coaxially mounted on a collet, made in the same layer of silicon-based material, characterized in that it includes a device that elevates or raises the outer coil of said balance spring above said layer of silicon-based material in order to improve the concentric development of said hairspring.

According to other advantageous features of the invention:

- the elevation device includes elevation means for connecting the outer coil of the balance spring, which are made in a second layer of silicon-based material;
- the elevation device has an end curve connected to said elevation means and formed in a third layer of silicon-based material, which forms a Breguet® coil;
- the end coil is a Phillips curve;
- the collet includes an extended part that projects from said balance spring so as to improve the guiding of said hairspring;
- the elevation device includes a second balance spring coaxially mounted on a second collet, connected to said elevation means, and formed in a third layer of silicon-based material to form a double balance spring in series;
- the hairspring has at least one part made of silicon dioxide to make it more mechanically resistant and to adjust its thermo-elastic coefficient,
- at least one collet has a metal part into which an arbour is driven which avoids damaging the inner diameters made of silicon-based materials;
- at least one inner balance spring coil has a Grossmann curve so as to improve the concentric development of said hairspring.

More generally, the invention relates to a timepiece, characterized in that it includes a one-piece hairspring in accordance with any of the preceding variants.

Finally, the invention relates to a method of manufacturing a hairspring that includes the following steps:

a) providing a substrate that includes a top layer and a bottom layer made of silicon-based material, b) selectively etching at least one cavity in the top layer to define the elevation means, made of silicon-based material, of said hairspring, c) joining an additional layer of silicon-based material to the etched top layer of the substrate, d) selectively etching at least one cavity in the additional layer to continue the pattern of the elevation means and to define the pattern of a balance spring and a collet, made of silicon-based material, of said hairspring, characterized in that it further includes the following steps:

e) selectively etching at least one cavity in the bottom layer to continue the pattern of the elevation means and to define the pattern of an end coil;

f) releasing the hairspring from the substrate.

According to other advantageous features of the invention:

- the etch of the balance spring and the collet in step d), is reversed with the etch of the end curve in step e),
- the pattern of an extended part of the collet is etched in at least one of the other layers of silicon-based material;
- the pattern of the end curve etched during step e) is replaced by the patterns of a second balance spring and a second collet so as to form a double balance spring in series;
- after the step of etching a balance spring, the method includes step g): oxidising the balance spring made of silicon-based material so as to make it more mechanically resistant and to adjust its thermo-elastic coefficient,
- prior to step e), the method includes step h): selectively depositing at least one metal layer on the bottom layer to define the pattern of a metal part on the collet,
- step h) includes step i): growing said deposition by successive metal layers at least partially over the surface of the bottom layer, so as to form the metal part for receiving an arbour, which is driven therein,
- step h) includes step j): selectively etching at least one cavity in the bottom layer for receiving the metal part and step k): growing said deposition by successive metal layers at least partially in said at least one cavity so as to form the metal part into which an arbour will be driven,
- step h) includes a last step l): polishing the metal deposition,
- several hairsprings are made on the same substrate.

BRIEF DESCRIPTION OF THE DRAWINGS

Other peculiarities and features will appear more clearly from the following description, which is given by way of non-limiting illustration, with reference to the annexed drawings, in which.

DETAILED DESCRIPTION OF PREFERRED EMBODIMENTS

The invention relates to a method, generally designated 1, for manufacturing a one-piece hairspring 21, 21' with an elevated or raised terminal curve for a timepiece movement. As illustrated in FIGS. 1 to 9, method 1 includes successive steps for forming at least one type hairspring, which can be entirely formed of silicon-based materials.

Figure 1:
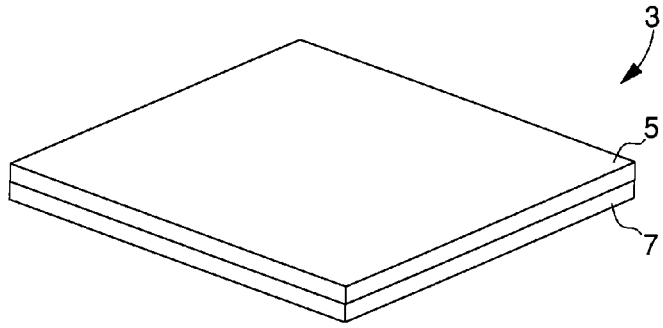
FIGS. 1 to 5 show successive views of the manufacturing method according to the invention.
Figure 9:
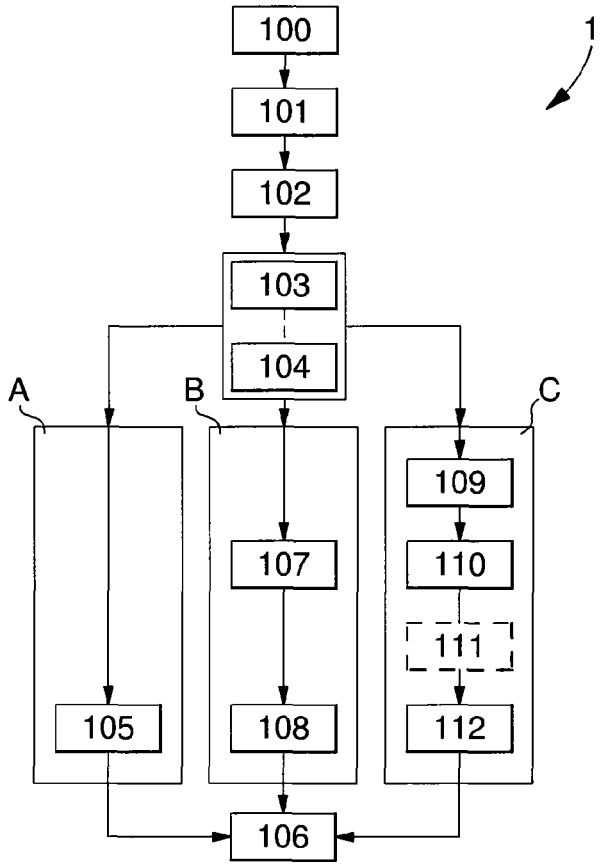
FIG. 9 shows a flow chart of the method according to the invention.

With reference to FIGS. 1 and 9, the first step 100 consists in taking a silicon-on-insulator (SOI) substrate 3. Substrate 3 includes a top layer 5 and a bottom layer 7 each formed of silicon-based material.

Preferably, in this step 100, substrate 3 is selected such that the height of bottom layer 7 matches the height of one part of the final hairspring 21.

Preferably, top layer 5 is used as spacing means relative to bottom layer 7. Consequently, the height of top layer 5 will be adapted in accordance with the configuration of the hairspring with a raised terminal coil 21, 21'.

Figure 2:
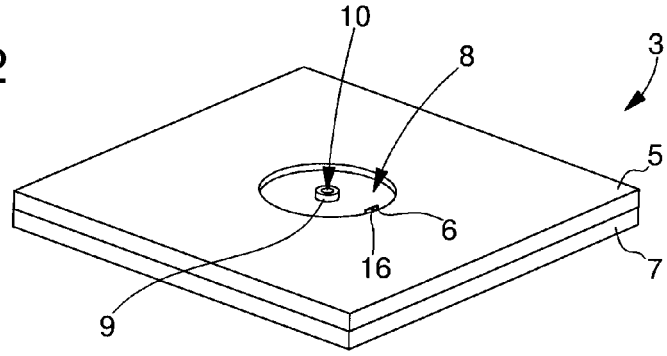

In a second step 101, seen in FIG. 2, a cavity 8 is selectively etched, for example by a DRIE (deep reactive ionic etch) process, in top layer 5 of silicon-based material. Cavity 8 preferably forms a pattern 6 that defines the inner and outer contours of a silicon part belonging to elevation device 2 of hairspring 21, 21'.

Figure 10:
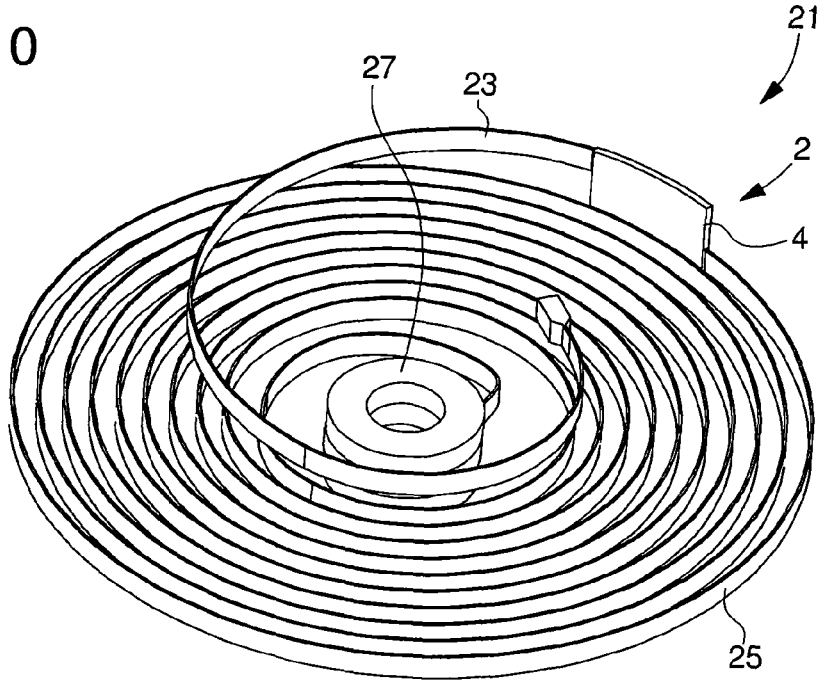
FIGS. 10 and 11 are perspective diagrams of a one-piece hairspring according to the invention
Figure 11:
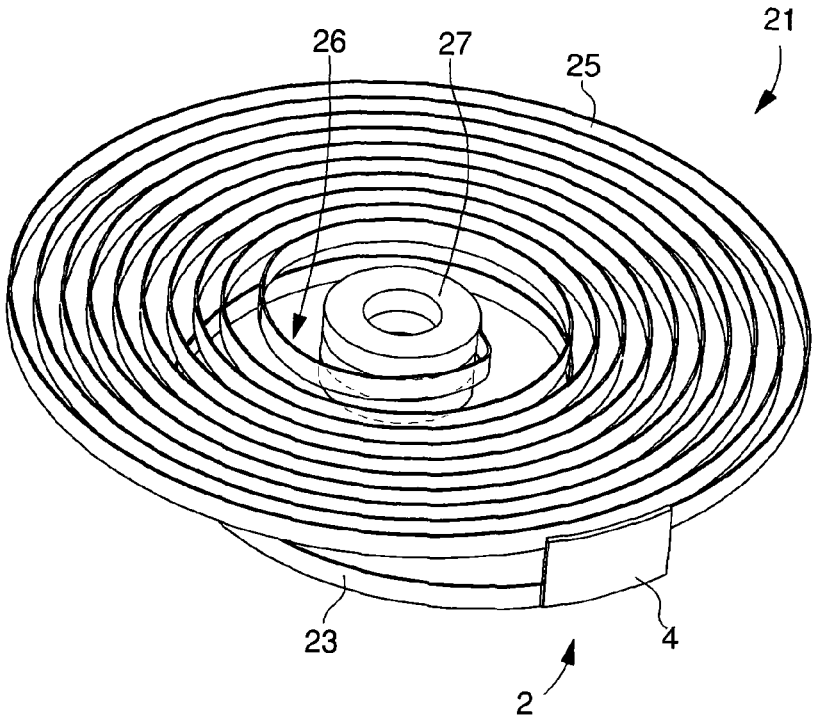

In a first variant illustrated in FIGS. 10 and 11, pattern 6 forms the median part of elevation means 4 of elevation device 2 of hairspring 21. As FIG. 2 illustrates, pattern 6 takes the approximate form of a curved, rectangular plate. However, advantageously according to method 1, the etch on the top layer 5 leaves complete freedom as regards the geometry of pattern 6. Thus, it might not necessarily be rectangular, but, for example, trapezoidal.

Figure 12:
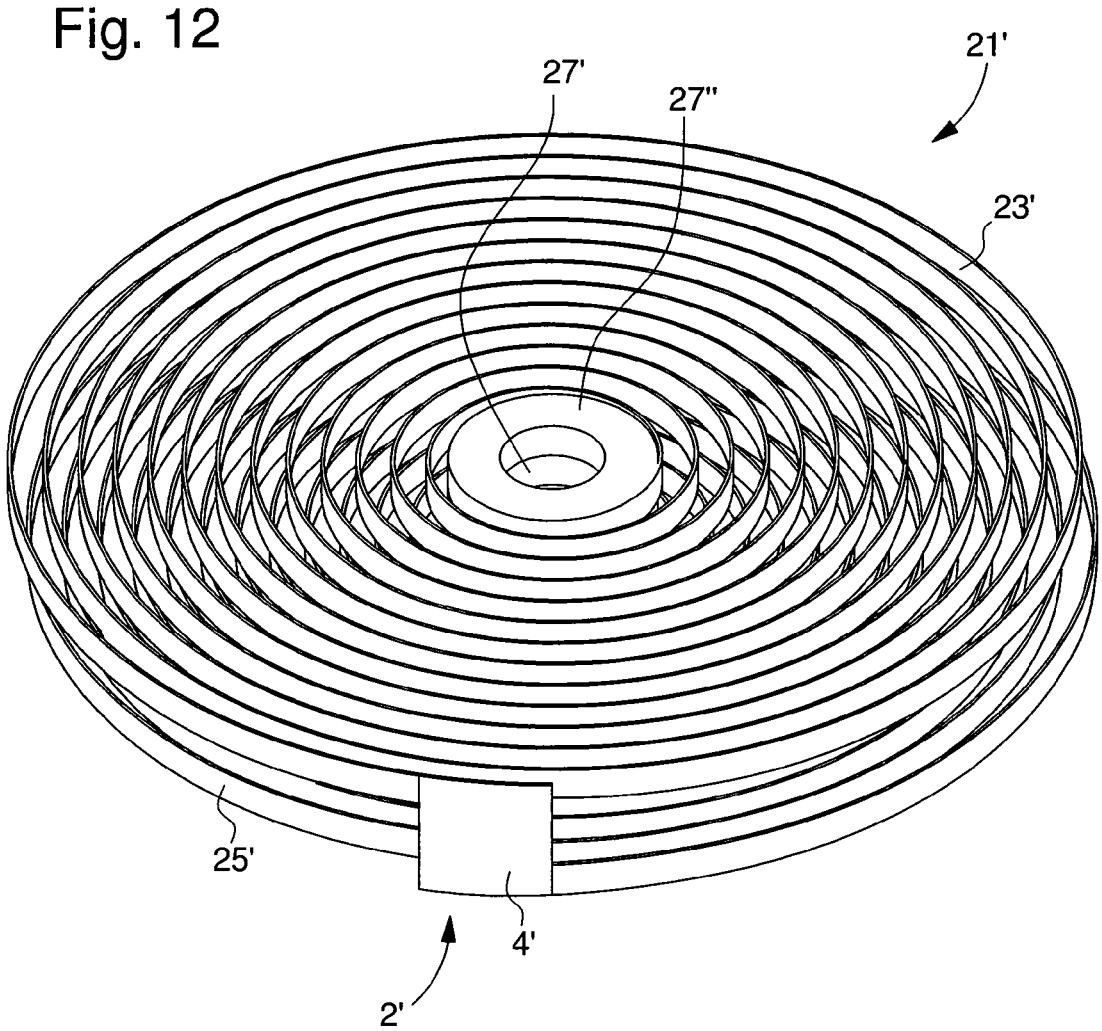
FIG. 12 is a perspective diagram of a hairspring according to a variant of the invention.

In a second variant, illustrated in FIG. 12, pattern 6 forms the intermediate part of elevation means 4' of elevation device 2' of hairspring 21'. As illustrated in FIG. 2, pattern 6 takes the approximate form of a curved, rectangular plate. However, advantageously according to method 1, the etch on top layer 5 leaves complete freedom as regards the geometry of pattern 6. Thus, in particular, it might not necessarily be rectangular, but, for example, could form a complete ring.

Preferably, for the first variant of FIGS. 10 and 11, another cavity 10 may be etched during step 101 so as to form a pattern 9 distinct from pattern 6, which defines the inner and outer contours of a silicon part respectively belonging to a collet 27 of hairspring 21.

In the example illustrated in FIGS. 10 and 11, pattern 9 thus forms the median part of collet 27 of hairspring 21 with a raised terminal curve. As illustrated in FIG. 2, pattern 9 is approximately cylinder-shaped with a circular section. However, advantageously according to method 1, the etch on top layer 5 leaves complete freedom as regards the geometry of pattern 9. Thus, in particular, it might not necessarily be circular but, may be, for example, elliptical and/or have a non-circular inner diameter.

Preferably, during step 101, at least one bridge of material 16 is made in order to hold the hairspring 21, 21' with a raised terminal curve on substrate 3 during manufacture. In the example illustrated in FIG. 2, it can be seen that a bridge of material 16 is left between one of the main surfaces of pattern 6 and the rest of the non-etched layer 5.

Figure 3:
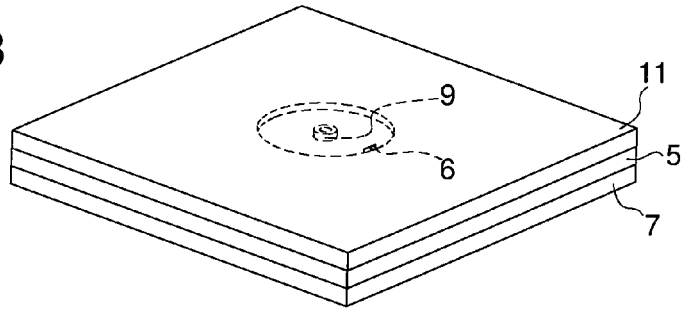

In a third step 102, shown in FIG. 3, an additional layer 11 of silicon-based material is added to substrate 3. Preferably, additional layer 11 is secured to top layer 5 by means of silicon fusion bonding (SFB). Thus, step 102 advantageously covers top layer 5 by binding the top faces of pattern 6 and possible 9, with a very high level of adherence, to the bottom face of additional layer 11.

Figure 4:
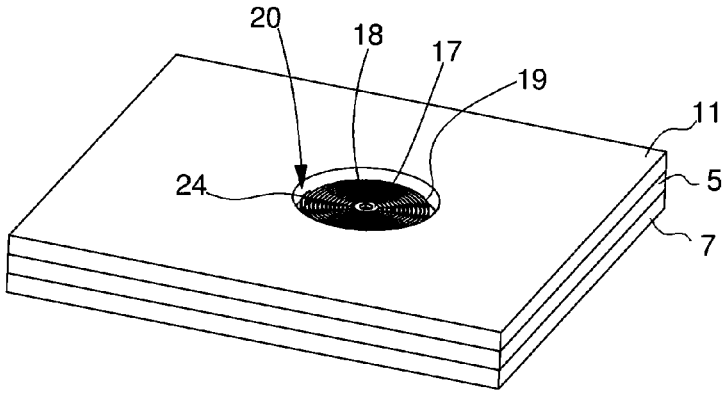

In a fourth step 103, shown in FIG. 4, cavities 18 and 20 are selectively etched, for example, by a DRIE process similar to that of step 101, in additional silicon layer 11. These cavities 18 and 20 form three patterns 17, 19 and 24, which define the inner and outer contours of the silicon parts of hairspring 21, 21' with a raised terminal curve.

In the example illustrated in FIG. 4, pattern 17 is approximately cylindrical with a circular section, and pattern 19, is approximately spiral-shaped. However, advantageously according to method 1, the etch on additional layer 11 allows complete freedom as regards the geometry of patterns 17 and 19. Thus, in particular, pattern 19 may, for example, have more coils or an inner coil including a Grossmann curve that improves its concentric development, as explained in EP Patent No. 1 612 627, which is incorporated herein by reference.

Preferably, for the first variant of FIGS. 10 and 11, pattern 17 made in additional layer 11 is of similar shape to and plumb with pattern 9 made in top layer 5. This means that cavities 18 and 10, respectively forming the inner diameter of patterns 17 and 9, communicate with each other and are approximately one on top of the other. In the example illustrated in FIGS. 10 and 11, patterns 9 and 17 respectively form the upper and median parts of collet 27 of hairspring 21.

Advantageously, as patterns 17 and 19 are etched at the same time, they form a one-piece part in additional layer 11. In the first variant illustrated in FIGS. 10 and 11, patterns 17 and 19 form respectively the lower portion of collet 27 and the balance spring 25 of hairspring 21 with a raised terminal curve. In the second variant illustrated in FIG. 12, pattern 17 and 19 respectively form first collet 27' and first balance-spring 25' of hairspring 21' with a raised terminal wave.

Preferably, pattern 24 made in additional layer 11 is of similar shape to and approximately plumb with pattern 6 made in top layer 5. In the first variant illustrated in FIGS. 10 and 11, patterns 6 and 24 respectively form the upper and intermediate parts of elevations means 4 of elevation device 2 of hairspring 21.

In the second variant illustrated in FIG. 12, patterns 6 and 24 respectively form the upper and intermediate parts of elevation means 4' of elevation device 2' of hairspring 21'. Of course, similarly, the pattern of bridge of material 16 can be extended into additional layer 11 during step 103.

After this fourth step 103, it is clear that patterns 17, 19 and 24 etched in additional layer 11 are connected by the bottom of pattern 24, with a high level of adherence, above pattern 6, which is etched in top layer 5.

Preferably, as shown in dotted lines in FIG. 9, method 1 can include a fifth step 104 that consists in oxidising at least pattern 19, i.e. the balance spring 25, 25' of hairspring 21, 21' so as to make said first balance spring more mechanically resistant and to adjust its thermo-elastic coefficient. This oxidising step is explained in EP Patent No. 1 422 436, which is incorporated herein by reference.

Advantageously, according to the invention, after fourth step 103, or preferably, after fifth step 104, method 1 may include three embodiments A, B and C, as illustrated in FIG. 9. However, each of the three embodiments A, B and C ends in the same final step 106, which consists in releasing the manufactured hairspring 21, 21' with a raised terminal curve from substrate 3.

Advantageously, release step 106 can be achieved simply by applying sufficient forces to hairspring 21, 21' to break bridge of material 16. This forces may, for example, be generated manually by an operator or by machining.

According to a first embodiment A, in a sixth step 105, cavities 12 and 14 are selectively etched, for example by a similar DRIE process to that of steps 101 and 103, in bottom layer 7 of silicon-based material. These cavities 12 and 14 form three patterns 13, 15 and 22, which define the inner and outer contours of silicon parts of hairspring 21, 21' with a raised terminal curve.

Figure 5:
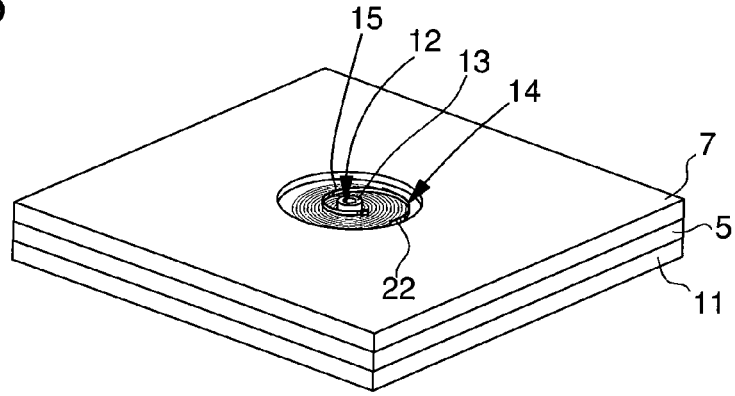

In the first variant illustrated in FIG. 5, pattern 13 is approximately cylinder-shaped with a circular section and pattern 15 is approximately spiral-shaped. Moreover, pattern 22 takes the form of a curved rectangular plate. However, advantageously according to method 1, the etch in bottom layer 7 leaves complete freedom as regards the geometry of patterns 13, and 22. Thus, in particular, pattern 15 may, for example, have more coils.

Preferably, for the first variant of FIGS. 10 and 11, pattern 13, made in bottom layer 7, is of similar shape to and substantially plumb with patterns 9 and 17 made in top layer 5 and additional layer 11. This means that cavities 12, 10 and 18 respectively forming the inner diameters of patterns 13, 9 and 17, communicate with each other and are approximately one on top of the other. In the first variant illustrated in FIGS. 10 and 11, patterns 17, 9 and 13 respectively form the high, median and low parts of collet 27 of hairspring 21.

Preferably for the second variant of FIG. 12, pattern 13 made in bottom layer 7 is of similar shape to and approximately plumb with pattern 17 made in top layer 5. This means that cavities 12 and 18 respectively forming the inner diameter of patterns 13 and 17 are approximately one on top of the other, without being contiguous. In the second variant illustrated in FIG. 12, patterns 17 and 13 respectively form the first collet 27' and the second collet 27" of the double series hairspring 21'.

Preferably, pattern 22 made in bottom layer 7 is of similar shape to and approximately plumb with pattern 6 made in top layer 5. In the first variant illustrated in FIGS. 10 and 11, patterns 22, 6 and 24 respectively form the low, intermediate and high parts of elevation means 4 of elevation device 2 of hairspring 21. In the second variant illustrated in FIG. 12, patterns 22, 6 and 24 respectively form the low, intermediate and high parts of elevation means 4' of elevation device 2' of hairspring 21'. Of course, the pattern of bridge of material 16 can be extended into bottom layer 7 during step 105.

Moreover, preferably for the first variant of FIGS. 10 and 11, pattern 15 is made to satisfy the criteria of a Phillips hairspring. Thus, advantageously, as patterns 22 and 15 are etched at the same time, they therefore form a one-piece part in bottom layer 7. In the first variant illustrated in FIGS. 10 and 11, patterns 22 and 15 respectively form the low part of elevation means 4 and the terminal curve 23 of elevation device 2 of hairspring 21.

Finally, preferably for the second variant of FIG. 12, pattern 15 is made in a similar manner to pattern 19 made during step 103. Thus, advantageously, as patterns 13, 22 and 15 are etched at the same time, they therefore form a one-piece part in bottom layer 7. In the second variant illustrated in FIG. 12, patterns 22, 15 and 13 respectively form the low part of elevations means 4' and the second balance spring 23' of elevation device 2', and the second collet 27" of double balance spring 21' in series. Advantageously, according to method 1, the etch in bottom layer 7 allows complete freedom as regards the geometry of pattern 15. Thus, pattern 15 may, for example, have more coils or an inner coil that includes a Grossmann curve for improving its concentric development, as explained in EP Patent No 1 612 627, which is incorporated herein by reference.

After final step 106, explained above, first embodiment A thus produces a one-piece hairspring 21 or 21' with a raised terminal curve, formed entirely of silicon-based materials, as shown in FIGS. 10 and 11 or 12. It is thus clear that there are no longer any problems as regards forming the parts, since they are directly formed on fixed elements during manufacture of hairspring 21 or 21'.

In the first variant illustrated in FIGS. 10 and 11, hairspring 21 includes a balance spring 25, coaxially connected to a collet 27, whose outer coil has an elevation device 2, mainly comprising a rectangular plate etched in three layers 11, 5, 7 which act as elevation means 4 and a terminal curve 23. As shown in FIGS. 10 and 11, the hairspring 21 with a raised terminal curve that is obtained therefore has a Breguet® configuration. Advantageously according to the invention, it will be noted that collet 27 is also etched in three layers 11, 5, 7, which improves the guiding of hairspring 21. Moreover, inner coil 26 of balance spring 25 has a Grossmann curve to improve its concentric development.

Further, the etches performed in steps 103 and 105 of method 1 leave complete freedom as to the geometry of terminal curve 23, balance springs 25, elevation means 4 and collet 27. Thus, in particular, the continuity between balance spring 25, elevation means 4 and terminal curve 23 may have a different geometry.

In accordance with the same reasoning, collet 27 can have uniformly peculiar or different dimensions and/or geometries at least over one of bottom, median and/or top parts 13, 9 and 17. Indeed, depending upon the arbour on which collet 27 will be mounted, the inner diameter can have a complementary shape over all or part of the height of collet 27. Likewise, the inner and/or outer diameters are not necessarily circular but may be, for example, elliptical and/or polygonal.

It should also be noted that the very high level of structural precision of deep reactive ionic etching decreases the start radius of balance spring 25, i.e. the outer diameter of collet 27, which means that the inner and outer diameters of collet 27 can be miniaturised. It is thus clear that hairspring 21 is able to receive, through cavities 18, 10 and 12, advantageously an arbour of smaller diameter than that which is currently usually manufactured.

Preferably, said arbour can be secured to the internal diameter 18 and/or 10 and/or 12 of one of collets 27. The lighting of collet can for example be made by resilient means etched in collet 27 made in a silicon based material. The arbour can be tightened using resilient means etched in silicon collet 27' or 27". Such resilient means may, for example, take the form of those disclosed in FIGS. 10A to 10E of EP Patent No. 1 655 642 or those disclosed in FIGS. 1, 3 and 5 of EP Patent No. 1 584 994, said patents being incorporated herein by reference.

In the second variant illustrated in FIG. 12, hairspring 21' has a first balance spring 25' coaxially connected to a collet 27' and whose outer coil includes an elevation device 2' mainly comprising a rectangular plate etched in three layers 11, 5, 7 acting as elevation means 4', a second balance spring 23', and a second collet 27". As shown in FIG. 12, the hairspring 21' thereby obtained has a double, series hairspring configuration.

Further, the etches performed in steps 103 and 105 of method 1 leave complete freedom as to the geometry of balance springs 25' and 23', elevation means 4' and collets 27' and 27". Thus, in particular, the continuity between balance springs 25', 23' and elevation means 4' may have a different geometry. It is also possible to envisage, as in the preceding variant, that the inner coils of each of balance springs 25' and 23' could have a Grossmann curve to improve the concentric development of each coil.

In accordance with the same reasoning, collets 27' and 27" can also have peculiar or different dimensions and/or geometries. Indeed, depending on which collet 27', 27" the arbour will be mounted with, the inner diameter of said collet can then have a complementary shape. Likewise, the inner and/or outer diameters of each collet 27', 27" are not necessarily circular but may be, for example, elliptical and/or polygonal.

It should also be noted that the very high level of structural precision of deep reactive ionic etching decreases the start radius of each of balance springs 25' and 23', i.e. the outer diameter of collets 27' and 27", which means that the inner and outer diameters of collets 27' and 27" can be miniaturised. It is thus clear that hairspring 21' is capable of receiving, through cavities 18 or 12, advantageously an arbour of smaller diameter than that which is currently usually manufactured.

Preferably, said arbour can be secured to the internal diameter 18 and/or 12 of one of collets 27', 27". The other collet can then be mounted either on the sprung balance bar or on the balance. The arbour can be tightened using resilient means etched in silicon collet 27' or 27". Such resilient means may, for example, take the form of those disclosed in FIGS. 10A to 10E of EP Patent No. 1 655 642 or those disclosed in FIGS. 1, 3 and 5 of EP Patent No. 1 584 994, said patents being incorporated herein by reference.

Figure 6:
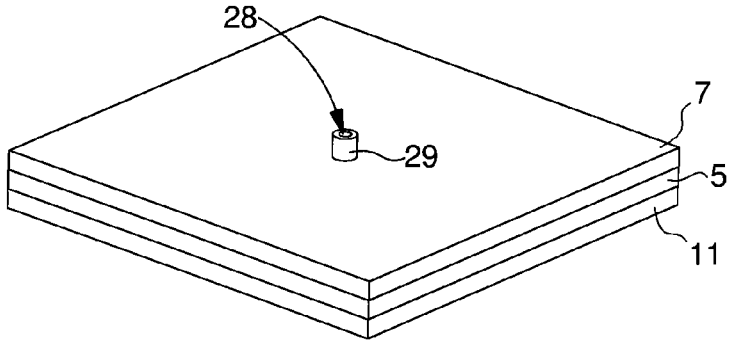
FIGS. 6 to 8 show views of the successive steps of alternative embodiments.

According to a second embodiment B, after step 103 or 104, method 1 includes a sixth step 107, shown in FIG. 6, consisting in implementing a LIGA process (from the German "röntgenLlthographie, Galvanoformung & Abformung"). This process includes a series of steps for electroplating a metal on the bottom layer 7 of substrate 3 in a particular shape, using a photostructured resin. As this LIGA process is well known, it will not be described in more detail here. Preferably, the metal deposited may be, for example, gold or nickel or an alloy of these metals.

In the example illustrated in FIG. 6, step 107 may consist in depositing a cylinder 29. In the example illustrated in FIG. 6, the cylinder 29 is for receiving an arbour, which is advantageously driven therein. Indeed, one drawback of silicon is that it has very few elastic and plastic zones, making it very brittle. The invention thus proposes to tighten an arbour, for example a balance staff, not against the silicon of collet 27, 27' or 27", but on the inner diameter 28 of metal cylinder 29, which is electroplated during step 107.

Advantageously, according to method 1, the cylinder 29 obtained by electroplating allows complete freedom as regards its geometry. Thus, in particular, the inner diameter 28 is not necessarily circular, but for example polygonal, which could improve the transmission of stress in rotation with an arbour of matching shape.

In a seventh step 108, similar to step 105 shown in FIG. 5, cavities are selectively etched, for example by a DRIE method, in bottom layer 7 of silicon-based material. These cavities allow patterns to be formed similar to patterns 13, 15 and 22 of the first embodiment A according to one of the two variants.

After final step 106, explained above, the second embodiment B thus produces a one-piece, hairspring with a raised terminal curve, formed of silicon-based materials with the same advantages as embodiment A, with the addition of a metal part 29. It is thus clear that there is no longer any problem as regards forming parts, since they are formed directly on fixed elements during manufacture of the hairspring 21 or 21'. Finally, advantageously, an arbour can be driven against the inner diameter 28 of metal part 29. One could therefore preferably envisage cavities 12 and/or 10 and/or 18 according to the variant including sections of larger dimensions than that of inner diameter 28 of metal part 29, so as to prevent the arbour being in push fit contact with collet 27, 27' or 27".

Figure 7:
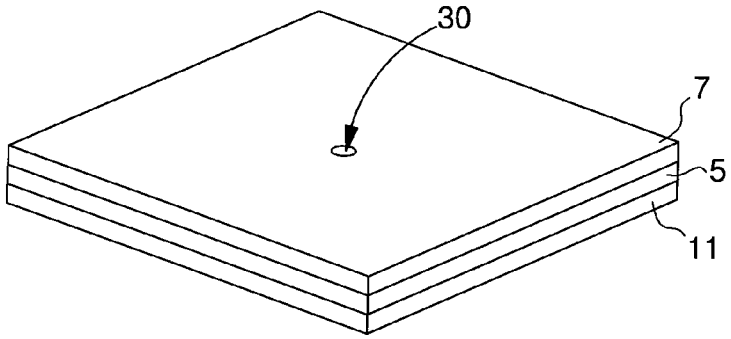

According to a third embodiment C, after step 103 or 104, method 1 includes a sixth step 109 shown in FIG. 7, consisting in selectively etching a cavity 30, for example, by a DRIE process, to a limited depth in bottom layer 7 of silicon-based material. Cavity 30 forms a recess to be used as a container for a metal part. As in the example illustrated in FIG. 7, the cavity 30 obtained can take the form of a disc. However, advantageously according to method 1, the etch of bottom layer 7 allows complete freedom as regards the geometry of cavity 30.

In a seventh step 110, as illustrated in FIG. 7, method 1 includes implementation of a galvanic growth or LIGA process for filling cavity 30 in accordance with a particular metal shape. Preferably, the deposited metal may be, for example, gold or nickel or an alloy of these metals.

Figure 8:
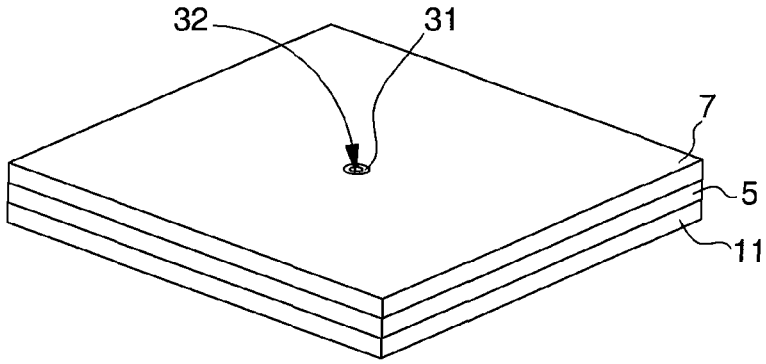

In the example illustrated in FIG. 8, step 110 may consist in depositing a cylinder 31 in cavity 30. Cylinder 31 is for receiving an arbour, which is advantageously driven therein. Indeed, as explained above, one advantageous feature of the invention consists in tightening the arbour, for example the balance staff, not against the silicon-based material of collet 27, 27' or 27" but on the inner diameter 32 of metal cylinder 31, which is electroplated during step 110.

Advantageously according to method 1, cylinder 31 obtained by electroplating allows complete freedom as regards its geometry. Thus, in particular, the inner diameter 32 is not necessarily circular but, for example, polygonal, which could improve the transmission of stress in rotation with an arbour of matching shape.

Preferably, method 1 includes an eighth step 111, consisting in polishing the metal deposition 31 made during step 110, in order to make said deposition flat.

In a ninth step 112, similar to step 105 shown in FIG. 5, cavities are selectively etched, for example, by a DRIE process, in bottom layer 7 of silicon-based material. These cavities form patterns similar to patterns 13, and 22 of the first embodiment A according to one of the two variants.

After final step 106 explained above, third embodiment C produces a one-piece, hairspring formed of silicon-based materials with the same advantages as embodiment A, with the addition of a metal part 31. It is thus clear that there are no longer any manufacturing problems, since the parts are directly formed on fixed elements during manufacture of hairspring 21 or 21'. Finally, advantageously, an arbour can be driven against inner diameter 32 of the metal part. One could therefore preferably envisage cavities 12 and/or 10 and/or 18 according to the variant having sections of larger dimensions than that of the inner diameter 32 of metal part 31, to prevent the arbour being in push fit contact with collet 27, 27', 27".

According to the three embodiments A, B and C, it should be understood that the final hairspring 21 or 21' is thus assembled prior to being structured, i.e. prior to being etched and/or altered by electroplating. This advantageously minimises the dispersions generated by current manufacturing methods and, consequently, improves the precision of a regulator member on which it will depend.

Advantageously, according to the invention, it is also clear that it is possible for several hairsprings 21 or 21' with a raised terminal curve to be made on the same substrate 3, which allows batch production.

Moreover, it is possible to make a driving insert of the same type as metal depositions 29 and/or 31 also, or solely from additional layer 11 and/or top layer 5.

Method 1 may include after step 105, 108 or 112, a step of the same type as step 104 which would consist in oxidising pattern 15, i.e. terminal curve 23 or balance spring 23' of hairspring 21 or 21' so as to make it more mechanically resistant and to adjust its thermo-elastic coefficient. A polishing step of the type of step 111 may also be performed between step 107 and step 108.

Advantageously according to the invention, whichever embodiment A, B or C is used, method 1 allows step 103, which consists in etching balance spring 25, 25' and collet 27, 27' in additional layer 11 to be reversed with step 105, 108 or 112, which consists in etching terminal curve 23 or balance spring 23' and collet 27" in bottom layer 7. This means that terminal curve 23 or balance spring 23' and collet 27" can be etched first on additional layer 11, then balance spring 25, 25' and collet 27, 27' can be etched in bottom layer 7. In such case, terminal curve 23 could be oxidised, in step 104, for example, before balance spring 25 is oxidised.

A conductive layer could also be deposited over at least a part of hairspring 21 or 21' so as to prevent isochronism problems. This layer may be of the type disclosed in EP Patent No. 1 837 722, which is incorporated herein by reference.

The height of collet 27 may be more limited than in FIGS. 10 and 11 of the first variant illustrated, i.e. for example, it may be limited to layers 5 and 11. The elevation means 4 could also take a different form from a curved rectangular plate.

Finally, at least a second bridge of material could be provided, so as to hold hairspring 21 to substrate 3 during manufacture, which could be performed between the outer curve of pattern 19 and the rest of the non-etched layer 11.

The invention claimed is:

1. A method of manufacturing a one-piece hairspring with a raised terminal curve, the method including the following steps:

a) providing a substrate including a top layer and a bottom layer of silicon-based materials, b) selectively etching at least one cavity in the top layer to form a first portion of an elevation element, made of silicon-based material, for the hairspring with the raised terminal curve, c) joining an additional layer of silicon-based material to the etched top layer of the substrate, d) selectively etching at least one cavity in the additional layer to form a second portion of the elevation element and to define patterns of a spiral-shaped balance spring having a thermo-elastic coefficient and a collet, made of silicon-based material, for the hairspring with the raised terminal curve, e) selectively etching at least one cavity in the bottom layer to form a third portion of the elevation element and to define a pattern of the raised terminal curve, made of silicon-based material, and f) releasing the one-piece hairspring with the raised terminal curve from the substrate so as to form the hairspring.

2. The method according to claim 1, wherein, prior to step e), it further includes the following step:

h) selectively depositing at least one metal layer on the bottom layer to define a pattern of a metal part of the hairspring with the raised terminal curve.

3. The method according to claim 2, wherein step h) includes the following step:

i) growing said deposition by successive metal layers at least partially over the surface of the bottom layer so as to form the metal part for receiving an arbour that is driven therein.

4. The method according to claim 2, wherein step h) includes the following phases:

j) selectively etching at least one cavity in the bottom layer for receiving the metal part;

k) growing said deposition by successive metal layers at least partially in said at least one cavity so as to form the metal part for receiving an arbour, which is driven therein.

5. The method according to claim 2, wherein, after step h), the method further includes the following step:

i) polishing the metal deposition.

6. The method according to claim 1, wherein, a pattern of an extended part of the collet is etched in at least one of the top layer, the bottom layer, and the additional layer of silicon-based material.

7. The method according to claim 1, wherein the pattern of the terminal curve etched during step e) is replaced by the patterns of a second balance spring and a second collet in order to form a double hairspring in series.

8. The method according to claim 1, wherein, after step d), the method further includes the following step:

g) oxidizing the spiral-shaped balance spring, made of silicon-based material, to make the balance spring more mechanically resistant and to adjust the thermo-elastic coefficient thereof.

9. The method according to claim 1, wherein several one-piece hairsprings are made on the same substrate.

10. A method of manufacturing a one-piece hairspring with a raised terminal curve, the method includes the following steps:

a) providing a substrate including a top layer and a bottom layer of silicon-based materials, b) selectively etching at least one cavity in the top layer to define a first portion of an elevation element, made of silicon-based material, for the hairspring with the raised terminal curve, c) joining an additional layer of silicon-based material to the etched top layer of the substrate, d) selectively etching at least one cavity in the additional layer to form a second portion of the elevation element and to define a pattern of the raised terminal curve, made of silicon-based material, e) selectively etching at least one cavity in the bottom layer to form a third portion of said elevation element and to define patterns of a spiral-shaped balance spring and a collet, made of silicon-based material, for the hairspring with the raised terminal curve, and f) releasing the one-piece hairspring with the raised terminal curve from the substrate so as to form the hairspring.

* * * * *